US005133377A

United States Patent [19]

Truxillo

[11] Patent Number: 5,133,377

[45] Date of Patent: Jul. 28, 1992

[54] INVALID WALKER

[76] Inventor: Peter L. Truxillo, 68 Tribune, Metairie, La. 70001

[21] Appl. No.: 622,733

[22] Filed: Dec. 5, 1990

[51] Int. Cl.[5] ..... A61H 3/00

[52] U.S. Cl. ..... 135/67; 135/75; 297/5

[58] Field of Search ..... 135/65–67, 135/75, 72, 69; 272/70.3, DIG. 9; 297/5–7

[56] References Cited

U.S. PATENT DOCUMENTS

| | | | |
|---|---|---|---|
| 673,100 | 4/1901 | Tyler . | |
| 1,394,224 | 10/1921 | Scott . | |
| 2,077,569 | 4/1937 | Kish | 155/22 |
| 2,539,577 | 1/1951 | Hack | 297/5 |
| 2,759,525 | 8/1956 | Ries | 297/6 X |
| 2,798,533 | 7/1957 | Frank | 155/22 |
| 3,237,940 | 3/1966 | Johnson | 297/5 X |
| 3,337,230 | 8/1967 | Golding | 297/5 X |
| 3,498,667 | 3/1970 | Winters | 297/5 |
| 3,516,425 | 6/1970 | Rigal | 135/67 |
| 3,584,890 | 6/1971 | Presty | 297/5 X |
| 3,993,349 | 11/1976 | Neufeld et al. | 297/6 |
| 4,074,683 | 2/1978 | Dichiara | 135/67 |
| 4,094,330 | 6/1978 | Jong | 135/67 |
| 4,184,618 | 1/1980 | Jones | 224/42.46 |
| 4,251,105 | 2/1981 | Barker | 297/6 |
| 4,253,678 | 3/1981 | Leclerc | 297/6 X |
| 4,272,071 | 6/1981 | Bolton | 272/70.4 |
| 4,277,100 | 7/1981 | Beougher | 272/70.3 X |
| 4,342,465 | 8/1982 | Stillings | 135/67 X |
| 4,387,891 | 6/1983 | Knochel | 272/70.3 |
| 4,461,471 | 7/1984 | Brastow | 272/70.3 |
| 4,532,948 | 8/1985 | Burrows | 135/67 |
| 4,621,804 | 11/1986 | Mueller | 272/70.3 |
| 4,623,163 | 11/1986 | Potts | 297/5 X |
| 4,676,416 | 6/1987 | Harmon | 224/42.46 |
| 4,777,973 | 10/1988 | Nakajima | 135/67 |
| 4,800,911 | 1/1989 | Endres et al. | 135/67 |
| 4,894,871 | 1/1990 | Schmerler | 135/67 X |
| 4,946,058 | 8/1990 | Stamm | 135/66 X |
| 4,948,156 | 8/1990 | Fortner | 272/70.3 X |

FOREIGN PATENT DOCUMENTS

| | | | |
|---|---|---|---|
| 1103142 | 6/1981 | Canada | 135/66 |

*Primary Examiner*—David A. Scherbel
*Assistant Examiner*—Lan Mai
*Attorney, Agent, or Firm*—C. Emmett Pugh

[57] ABSTRACT

An improvement in walkers including a set of specially designed, spring biased, retractable casters on at least the four corner legs of the walker apparatus to assist the user in moving the walker apparatus from one point to another. The walker further includes an adjustable seating system situated to the rear of the user for ease of utilization without the need to turn around when seating oneself. Additionally, an accessory food tray subsystem is provided. The walker is designed to provide an effective means for invalids, the elderly, and the like to comfortably, easily and without fear move about an area, while also having a seat and tray readily available so that the user can rest and even comfortably sit and eat or engage in other activities, thereby relieving the user of the necessity of having to manipulate furniture in sitting and getting up, an often painful process for the infirm.

14 Claims, 2 Drawing Sheets

INVALID WALKER

BACKGROUND OF THE INVENTION

1. Field of Invention

The present invention relates to devices for aiding the elderly and handicapped and more particularly to an improvement in walkers. The walker of the present invention includes a specially designed, spring biased, retractable caster system to assist the user in directing the apparatus from one point to another. The invention preferably further includes an adjustable seating system situated to the rear of the user for ease of utilization, as well as an accessory food tray system.

The system of the present invention is designed to provide an effective means for invalids, the elderly, and the like to comfortably and without fear move about an area, while also having a seating and tray apparatus such that the user can rest and even comfortably sit and eat or engage in other activities, thereby relieving the user of the necessity of having to manipulate furniture in sitting and getting up, an often painful process for the infirm.

2. Prior Art and General Background

While the prior art teaches a variety of devices for assisting handicapped and elderly individuals during walking, it does not contemplate a lightweight and effective walker wherein the user may easily sit and rest during utilization of the device.

The activity of walking, sitting and standing, especially for the elderly and handicapped, can be an arduous, painful, and even dangerous activity, as these individuals frequently lack the strength, coordination, and balance to walk even short distances. As a result, numerous devices have been invented, ranging from the walking stick and cane to crutches, wheelchairs and the like, in order to assist the user in the walking process.

As reflected in the prior art, it appears that walkers came about in the late 1800's as still another alternative in assisting its user in the walking process. Since that period, literally dozens of variations have occurred relative to the traditional walker design, including the incorporation of spoke wheels (U.S. Pat. No. 4,387,891), circular configurations (U.S. Pat. No. 4,272,071), wheels with braking means (U.S. Pat. No. 4,461,471), collapsible designs (U.S. Pat. No. 4,676,416), etc.

Also included in the prior art are various patents teaching seating mechanisms associated with the various walkers, all of which are distinguishable from the present invention for reasons further discussed below.

A list of prior patents which may be of interest is presented below:

| Patent No. | Patentee(s) | Issue Date |
|---|---|---|
| 4,777,973 | Nakajima | 10/18/1988 |
| 4,676,416 | Harmon | 06/30/1987 |
| 4,621,804 | Mueller | 11/11/1986 |
| 4,532,948 | Burrows | 08/06/1985 |
| 4,461,471 | Brastow | 07/24/1984 |
| 4,387,891 | Knochel | 06/14/1983 |
| 4,272,071 | Bolton | 06/09/1981 |
| 4,251,105 | Barker | 02/17/1981 |
| 4,184,618 | Jones | 01/22/1980 |
| 4,094,330 | Jong | 06/13/1978 |
| 4,074,683 | Ki Chiara | 02/21/1978 |
| 3,993,349 | Neufeld et al. | 11/23/1976 |
| 2,798,533 | Frank | 07/09/1957 |
| 2,077,569 | Kish | 04/20/1937 |

-continued

| Patent No. | Patentee(s) | Issue Date |
|---|---|---|
| 1,394,224 | Scott | 10/18/1921 |
| 673,100 | Tyler | 04/30/1901 |

As may be determined by a review of the above, the prior art has failed to anticipate a walker having a seat structure behind the user, within easy reach and in an easy position to get to while in use. In the invention the user merely sits down during use, and the seat structure supports him/her. The positioning of the seating means is all important with the use contemplated in the present case, as turning around or having to otherwise prepare or position the user prior to sitting may not be an option in some circumstances involving weak or otherwise impaired users.

As can be seen in U.S. Pat. Nos. 673,100, 2,798,533, 3,993,349, and 4,532,948, the prior art has contemplated seats for use in conjunction with walkers, but all known embodiments teach the seat facing the user while the walker is in use, requiring the user to turn around prior to sitting.

U.S. Pat. No. 4,621,804 entitled "Therapeutic Roller/Walker", teaches a "crotch-cradling panel" wherein the user straddles a strap, again distinguishable in form and function from the present device. Further, the ,804 reference primarily contemplates a roller primarily with wheeled means affixed thereto, and a walker secondarily, and is not at all related in structure and use to the present invention.

Further, the caster wheels in the present invention, with their spring loaded design feature, retract to allow a firm, stable support to contact the ground area, unlike the ,804 patent's uncontrollable wheels.

The prior art has thus failed to contemplate a device which might be used not only as a walker but also as a sitting and activity area. While some of the patents above may teach walkers having seats, and some individually having trays, none teach a practical combination of the two.

Further, the walkers of the prior art do not provide the stability and ease of use during the process of sitting and getting up out of the chair, as taught in the present invention. As indicated above, the prior art walkers with seats require that the user turn around without support, and sit; of course, in getting up, the user must turn around to utilize the walker. It is asserted that such an activity, for the elderly or infirm, can be somewhat difficult and even traumatic, when the user is weak and without good balance.

GENERAL, SUMMARY DISCUSSION OF THE INVENTION

The present invention overcomes these prior art problems by providing an adjustable, safe, controllable walker system which is highly reliable, relatively economical and very effective in assisting a variety of handicapped and elderly individuals in their walking and other movement activities.

The preferred embodiment of the present invention comprises a new, lightweight walker system having adjustable rear seating means, a front tray piece, and a retracting caster system.

The present invention is configured to easily adjust in a variety of fashions, including height and seat/walker separation width.

The caster system of the present invention teaches an effective means of providing rolling support for the walker system, as it is lifted and moved during use, but is configured to retract when weight is applied to the system, as when the user exerts pressure upon the front walker portion or sits upon the rear seating portion.

The present invention provides a tray piece which may be removed, with the piece being configured to allow support during eating, reading, or the like while the user is sitting upon the seat area of the present system.

The present system is further configured to allow for the removal of the rear seating portion, wherein the walker portion remains and may be used independently of the seat portion.

Unlike the prior art, which taught seating means arranged in a rather impractical fashion which required the often impaired user to turn around to sit, the present invention teaches a walker system wherein the seating means is arranged in a practical, adjustable, and stable fashion, and wherein the user may immediately sit and rest during the use of the walker when necessary. Further, the present invention preferably is configured to provide ample bracing, which may be utilized by the user when sitting or attempting to stand from the sitting position.

It is an therefore an object of the present invention to provide a walker which incorporates stable, adjustable, lightweight, rear seating means.

It is a further object of the present invention to provide a walker system which incorporates retractable caster means to assist the user in the walking operation.

It is a further object of the present invention to provide a walker system which includes a removable, rear seating portion.

It is still a further object of the present invention to provide a walker system which includes removable, adjustable tray means.

Lastly, it is an object of the present invention to provide a walker system which may be easily utilized by an invalid, handicapped, or elderly person.

BRIEF DESCRIPTION of the DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED. EXEMPLARY EMBODIMENT(S)

Figure 1:
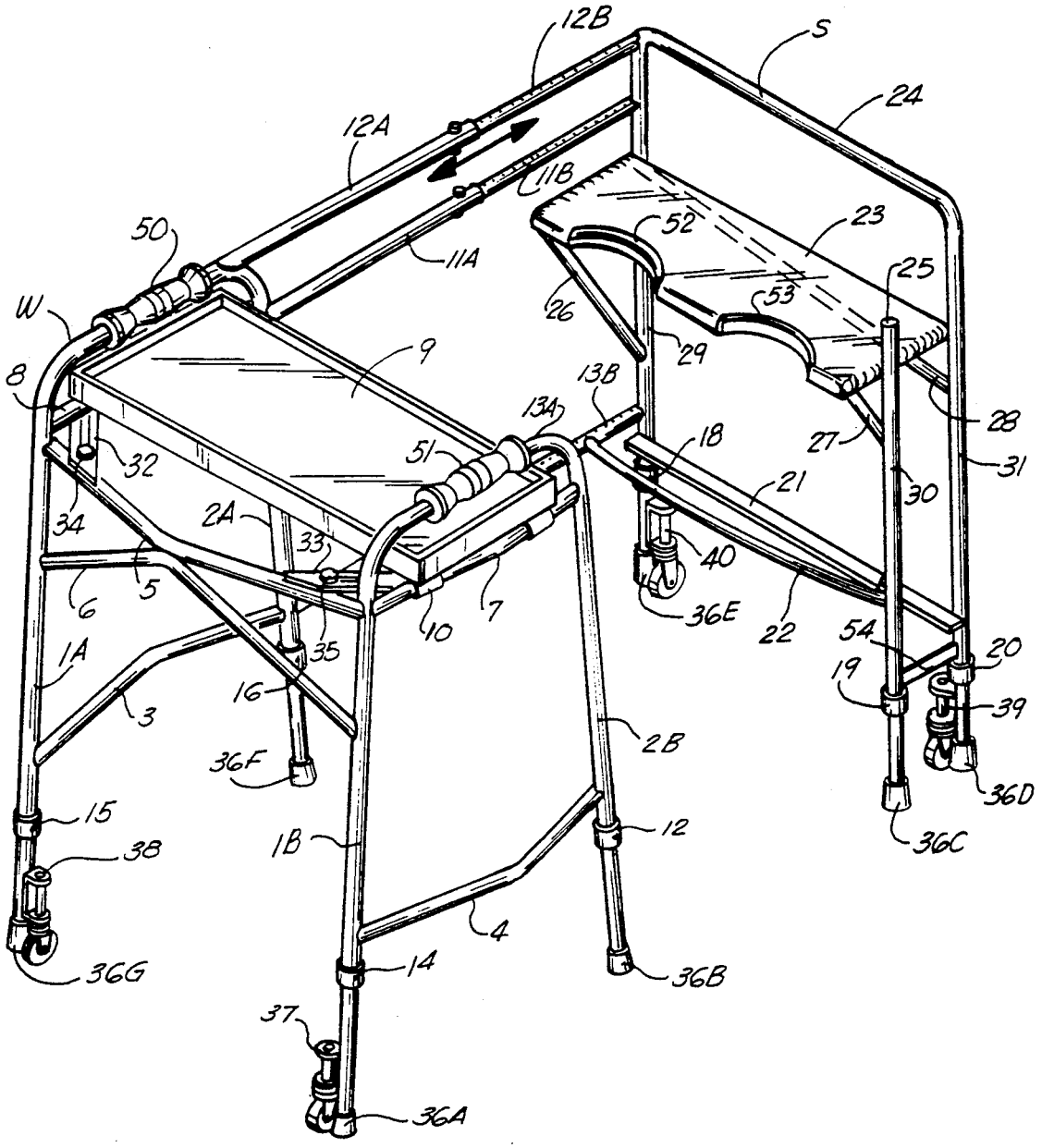
FIG. 1 is an isometric view of the exemplary, preferred embodiment of the walker system of the present invention, illustrating the configuration and placement of the rear seat member section relative to the front walker member section, and further illustrating the placement and configuration of the retractable casters and the easily removable front tray piece or member.

As can be seen in FIG. 1, the walker system of the preferred, exemplary embodiment of the present invention comprises primarily two sections—a first, front section relating to a modified walker structure W and a second, rear, seating structure or section S slidingly adjustably affixed to the front section.

The walker structure W of the exemplary embodiment comprises a support structure having front legs 1A, 1B and rear legs 2A, 2B, all having rubber footing caps 36A–D affixed to the bottom end of each of the legs, with the front and rear legs including between them upper, side handle supports or grips 50, 51. The front legs 1A, 1B and rear legs 2A, 2B are adjustable in height via telescopic adjustment arrangements 15, 14, 17, 16, respectively.

In order to brace the walker structure, lower side (3, 4), upper (7, 8) and crossed front (6, 5) trusses are weldingly affixed to the front and rear legs 1A–D. In the exemplary embodiment of the present invention, the lower side trusses 3, 4 preferably are angulated in an outward fashion to provide more interior room for the user when walking.

Figure 3:
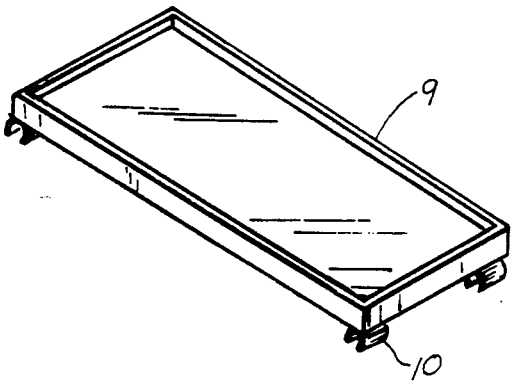
FIG. 3 is an isometric view of the easily removable tray piece of the walker system of FIG. 1.

The upper side trusses 7, 8 support an easily removable tray 9 and are preferably adjustably held in place via front-side bracket (32, 33) and nut (34, 35) arrangements. As more clearly shown in FIG. 3, the tray 9 is preferably held in place via "C" clamps 10 affixed to its underside, which clamps grippingly engage the upper side trusses 7, 8 as shown in FIG. 1.

Again referring to FIG. 1 (and FIG. 2), the rear seat structure section S of the exemplary system comprises front (30) and rear (31, 29) legs, adjustable in their height via telescopic adjustment arrangements 19, 20, 18, respectively. The front (30) and rear (31, 29) legs each have affixed to their respective bottom end a rubber cap footing 36C–E or the like. The front leg 30 also has an upper cap 25 affixed thereto as a finishing member.

The exemplary embodiment of the walker system of the invention thus includes at least seven support legs, namely, walker section legs 1A–1D and seat section legs 29–31, all of which are preferably telescopically adjustable in their height.

Affixed to the front (30) and rear (31, 29) legs via respective bracing 27, 28, and 26 is a seat member 23, providing, for example, a generally flat, planer support surface for the user to sit upon. Alternatively, the seat member 23 could have its upper support surface configured with indented areas for comfort and/or include a cushioned area.

Figure 2:
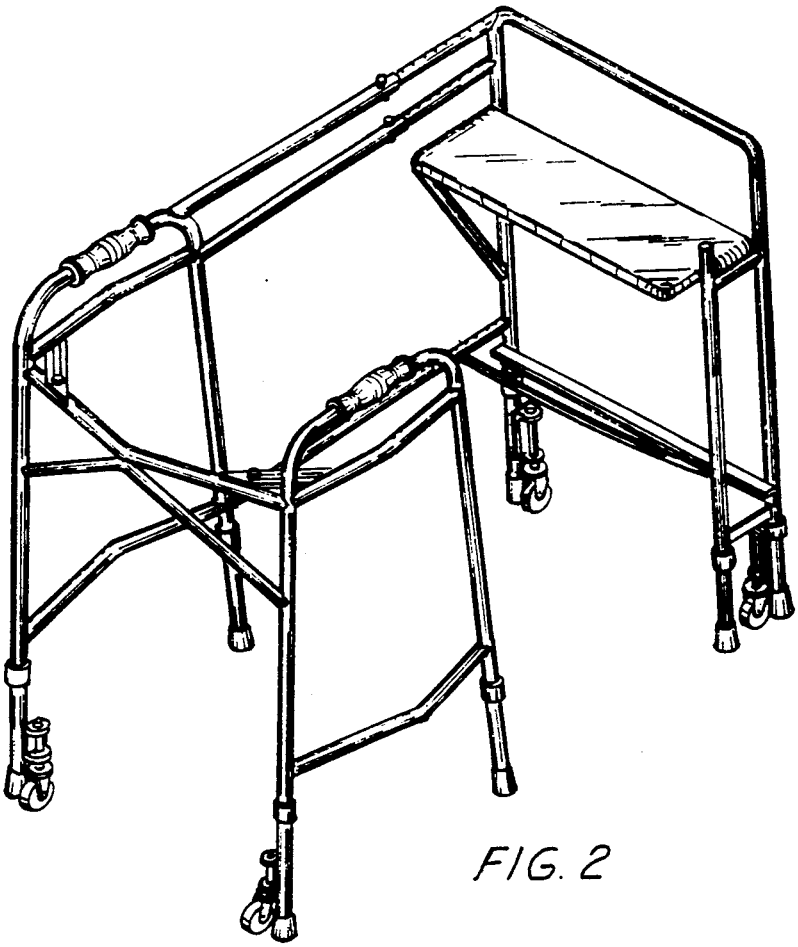
FIG. 2 is a isometric view of the walker system of FIG. 1, illustrating the walker system of the present invention, but without the tray piece and with a differently configured seat.

The seat member 23 includes front, leg indentations 52, 53 in the exemplary embodiment comprising, for example, eight inch (8") circular cuts or indentations, for facilitating the sitting upon and getting up from the seat member 23, while the alternative seat member 23' of FIG. 2 does not include such indentations. These front indentations 52, 53 anatomically configure the seat member 23 to the rear portions of the user's legs which come into contact with the front of the seat member.

Further supporting the seat structure S are lower support trusses 21, 22 and spacer 54, which form bracing between legs 29, 30, 31.

The rear legs 31, 29 are further configured to include between them a back rest bar 24 for supporting the back of the user when the user is sitting down on the seat 23 (23').

Telescoping, adjustable, side supports 11A/B, 12A/B, 13A/B, connecting the seating structure S with the walker structure W, provide effective, stable, support means for the user when sitting upon the seat 23 (23') and attempting to get up therefrom.

Figure 4:
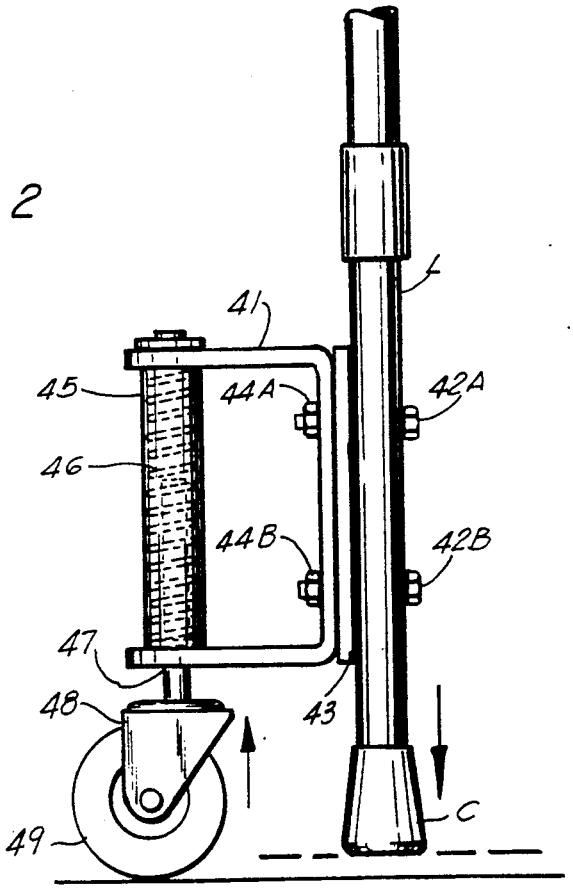
FIG. 4 is a side, detail view of an exemplary one of the retractable caster member of the walker system of FIG. 1, with the internal spring bias member being shown in phantom line.

In order to assist the user in moving the walker device during walking, four spring biased, retractable casters 37, 38, 39, 40 are provided at the bases of the four corner legs 1A, 1B, 29, 31, respectively. As more clearly shown in FIG. 4, the casters used in the exemplary embodiment are affixed to the legs L with bolt (42A and B) and nut (44A and B) arrangements, affixing each of the caster "C" frames 41 firmly to its respective leg. A spacer 43 may also be used if desired.

Held within the juxtaposed caster "C" frame 41 is a cylindrical member 45 containing the upper end of the caster shaft 47 with an internal spring 46 affixed thereto. The spring arrangement 46 provides biasing means to bias the caster wheel downwardly from the member 45 in a fashion such that the wheel 49, via bracket 48, is forced by the spring biased shaft down against the floor to support the walker when no significant weight or force is applied to the frame of the walker. When it is in this supporting disposition, the spring biased, retracting casters 36–40, preferably located at the four corners of the over-all walking apparatus, apply a lifting, supporting action to the walking apparatus, providing it with complete rolling mobility.

However, when weight is applied by the user upon the walker, that weight is transferred to the wheel 49, which, through communication with the shaft 47 to the spring 46, overcomes the downward bias of the spring 46 and forces each of the legs L down with respect to the casters until the walker rests upon and is supported by the four corner rubber caps C, providing a firm friction surface for assistance in stably supporting the user.

In use, the present invention is utilized in the walking mode as one would use an ordinary walker, that is, the user stands within the interior area defined by the walker frame between the handle area and the legs 1A–1B and 29/30, gripping the handles 51, 50, and cyclically placing weight upon the handles to assist in movement and then "unweighting" the walker. However, in the exemplary embodiment of the invention, this "unweighting" allows the walker to rise up a small degree of amount under the spring biasing action, permitting the walker to be rolled forward between steps. At this relatively "raised" point the "deweighting" of the walker thus allows the spring bias 46 of the casters to carry the load of the walker system itself, both front and rear, the wheels providing a low friction means of facilitating movement of the walker by allowing it to be rolled forward without the necessity of the user totally lifting the walker up completely off the ground (floor) and moving it forward while holding up the complete weight of the walker.

When the user has reached the desired area, he or she may wish to pivot the walker system to provide an optimal seating or resting area. This operation is almost effortless, as the wheeled casters include a wheel bracket 48 which pivots three hundred (360) degrees, allowing the system to be moved without effort to the desired position. When positioned, the user merely utilizes the side support bar 12A/B and/or handles 50, 51, in conjunction with seat bar 24, to lower himself/herself upon the seat 23 (23').

In the seated position, the present invention provides back support for comfort via the back bar 24, and an easily reached tray 9 area for eating foods, reading, or other activities. If desired, the forward position of the tray area 9 may be adjusted via the telescoping side bar supports 12A/B, 11A/B, and 13A/B. It is noted that the tray 9 is supported by the walker section W in front of and above the seat member 23 (23').

Thus, the exemplary embodiment of the walking apparatus of the present invention assists a person who has a walking disability to move about in a substantially erect posture (although usually bent forward to some degree) by means of that person's own walking motive force or power.

If so desired, rather than using two, horizontally extended, side bar supports 12A/B, 11A/B, they effectively could be combined into only one. Additionally, if so desired, a like side bar could be added to the "near" side (as viewed in the perspective of FIGS. 1 and 2) to add further structural strength to the walker structure. Such an added side bar could be pivotally mounted to, for example, the upper part of the leg 1C and have a distal, interfacing end for temporarily latching that end of the added side bar to, for example, the top of the leg 30. Such an exemplary arrangement would allow it to be either raised up or lowered down out of the way, when so desired, to allow for ease of entry and exit with respect to the interior area of the walker.

The present system in its preferred embodiment may be constructed of, for example, aluminum tubing (circular or squared), and may be anodized for cosmetic effect, if so desired. An alternative material would be plastic tubing.

It is noted that, as used herein, a "horizontally extended" member does not necessarily require that that member be completely or perfectly horizontal but only that it extend in the horizontal direction either fore or aft or laterally, even though it may be angled upwardly or downwardly in doing so.

The embodiment(s) described herein in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A walking apparatus for assisting a person who has a walking disability to move about in a substantially erect posture by means of that person's own walking motive power, while providing a portable seat configured to allow the user to rest in seated position from a walk from one point to another, comprising:

a walker section having a front, a rear and two sides, including:

first and second, telescopically adjustable front legs, first and second walker section rear legs, and first and second horizontally extended bars, said first horizontally extended bar connecting said first front leg to said first rear leg, and said second horizontally extended bar connecting said second front leg and said second rear leg, said first front leg, first rear leg, and first horizontally extended bar being located on one side of said walker forming part of a walker frame, and said second front leg, second rear leg and second horizontally extended bar being located on the other side of said walker forming the other part of the walker frame, said first and second horizontal bars each carrying a hand grip, said front legs defining the front of said walker section and said walker section rear legs defining the rear of said walker section; and a seat section connected to and located behind said walker section and including at least two, seat section legs, and a horizontally extended seating member carried by said two seat section rear legs; and at least one telescopically adjustable, horizontally extended brace member extending between and attached to said walker and said seat sections connecting them together, with said seat section being located to the rear of said walker section behind said walker section rear legs and defining with said walker frame an interior area in which the person can stand with at least the front of the walker section to the person's front and the seat section to the person's rear, said seat section being spaced with regard to said walker section allowing such that the person can grasp said hand grips of said first and second horizontal bars of the walker section, for stability and to impart confidence, as the person simultaneously sits down upon or gets up from said seat section, said seat member being situated and located with respect to said walker frame so as to allow the person to merely sit down in order to sit and rest upon said seat member after having used said walker section as a walker, in a substantially erect posture, without having to step back from said walker section.

2. The walker apparatus of claim 1, wherein there is further included:

retractable, spring biased casters affixed to said front legs of said walker section allowing the rolling movement of said walker apparatus in use as a walker.

3. The walker apparatus of claim 2, wherein there is further included:

retractable, spring biased casters affixed to said rear legs of said seat section allowing the complete rolling movement of said walker apparatus in use as a walker.

4. The walker apparatus of claim 3, wherein:

said front and said rear legs of said walker section are telescopically adjustable in height.

5. The walker apparatus of claim 3, wherein:

said rear legs of said seat section are telescopically adjustable in height.

6. The walker apparatus of claim 1, wherein there is further included:

a tray located on and supported by said walker section in front of and above said seat member.

7. The walker apparatus of claim 1, wherein:

said horizontally extended bar is telescopically adjustable in length.

8. The walker apparatus of claim 1, wherein:

said walker frame, said horizontally extended bar and said rear legs of said seat section are comprised of tubing.

9. The walker apparatus of claim 1, wherein said seat member includes:

circular indentations at its front anatomically configuring said seat member to the rear portion of the user's legs coming into contact with said seat member.

10. The walker apparatus of claim 1, wherein said seat section further includes:

at least one front leg located behind said front and rear legs of said walker section and in front of said rear legs of said seat section, providing at least a total of seven support legs.

11. A method of assisting a person who has a waling disability to move about in a substantially erect posture by means of that person's own walking motive power to a desired destination and thereafter sit, allowing the user to rest in seated position from the walk, comprising the following steps:

a. providing a walker apparatus, comprising:

a walker section having a front, a rear and two sides, including first and second, telescopically adjustable front legs, first and second walker section rear legs, and first and second horizontally extended bars, said first horizontally extended bar connecting said first front leg to said first rear leg, and said second horizontally extended bar connecting said second front leg and said second rear leg, said first front leg, first rear leg, and first horizontally extended bar being located on one side of said walker forming part of a walker frame, and said second front leg, second rear leg and second horizontally extended bar being located on the other side of said walker forming the other part of the walker frame, said first and second horizontal bars each carrying a hand grip, said front legs defining the front of said walker section and said walker section rear legs defining the rear of said walker section; and a seat section connected to and located behind said walker section and including at least two, seat section rear legs, and a horizontally extended seating member carried by said two seat section rear legs; and at least one telescopically adjustable, horizontally extended brace member extending between and attached to said walker and said seat sections connecting them together, with said seat section being located to the rear of said walker section behind said walker section rear legs and defining with said walker frame an interior area in which the person can stand with at least the front of the walker section to the person's front and the seat section to the person's rear, said seat section being spaced with regard to said walker section such that the person can grasp said hand grips of said first and second horizontal bars of the walker section for stability and to impart confidence, as the person simultaneously sits down upon or gets up from said seat section, said seat member being situated and located with respect to said walker frame so as to allow the person to merely sit down in order to sit and rest upon said seat member after having used said walker section as a walker in a substantially erect posture, without having to step back from said walker section.

b. standing within said interior area facing toward the front of the walker section with the seat section to one's rear;

c. placing one's hands upon said handles;

d. applying a part of one's weight to said handles in a downwardly directed fashion, causing said spring biased, retracting casters to be retracted from any ground engaging, supporting contact, and concurrently taking a walking step forward;

e. thereafter removing at least most of one's weight from said handles, allowing said spring biased, retracting casters to apply a lifting, supporting action to said walking apparatus, providing complete rolling mobility to it;

f. rolling the walker apparatus in the desired direction to move using one's own motive power; and g. cyclically repeating steps (d)–(f) until desiring to rest or reaching the desired destination; and h. thereafter ultimately sitting down upon the seat member while simultaneously grasping said first and second horizontal bars for stability and imparting confidence in the user, and, when the desired destination has been reached, ultimately releasing said handles.

12. The method of assisting the infirm person of claim 11, wherein in step "a" there is included the sub-step of:

providing telescoping adjustment means for telescopically adjusting the height of all of said legs of said walker and said seat sections and for telescopically adjusting the separation distance between said walker and said seat sections by telescoping adjusting the length of said horizontally extended brace; and adjusting the height of said legs to be compatible with the height of the user & adjusting the separation distance between said sections to provide adequate room in said interior area for the user.

13. A walking apparatus for assisting a person who has a walking disability to move about in a substantially erect posture by means of that person's own walking motive power, while providing a portable seat configured to allow the user to rest in seated position from a walk from one point to another, comprising:

a walker section having a front, a rear and two sides, including first and second telescopically adjustable front legs, first and second walker section rear legs, and first and second horizontally extended bars, said first horizontally extended bar connecting said first front leg to said first rear leg, and said second horizontally extended bar connecting said second front leg and said second rear leg, said first front leg, first rear leg, and first horizontally extended bar being located on one side of said walker forming part of a walker frame, and said second front leg, second rear leg and second horizontally extended bar being located on the other side of said walker forming the other part of the walker frame, said first and second horizontal bars each carrying a hand grip, said front legs defining the front of said walker section and said walker section rear legs defining the rear of said walker section; and a seat section connected to and located behind said walker section and including two, seat section rear legs, at least one seat section front leg, there being a total of at least seven support legs between said walker and said seat sections, and a horizontally extended seating member carried by said two seat section rear legs and said seat section front leg;

a tray located on and supported by said walker section in front of and above said seat member;

retractable, spring biased casters affixed to at least said front legs of said walker section and to said rear legs of said seat section allowing the complete rolling movement of said walker apparatus in use as a walker; and at least one telescopically adjustable, horizontally extended brace member extending between and attached to said walker and said seat sections connecting them together, with said seat section being located to the rear of said walker section behind said walker section rear legs and defining with said walker frame an interior area in which the person can stand with at least the front of the walker section to the person's front and the seat section to the person's rear, said seat section being spaced with regard to said walker section such that the person can grasp said hand grips of said first and second horizontal bars of the walker section, for stability and to impart confidence, as the person simultaneously sits down upon or gets up from said seat section, said seat member being situated and located with respect to said walker frame so as to allow the person to merely sit down in order to sit and rest upon said seat member after having used said walker section as a walker in a substantially erect posture, without having to step back from said walker section.

14. The walker apparatus of claim 13, wherein:

said front and said rear legs of said walker section and said front leg and said rear legs of said seat section are telescopically adjustable in height;

said horizontally extended bar is telescopically adjustable in length; and said walker frame, said horizontally extended bar and said front leg and said rear legs of said seat section are comprised of telescoping tubing sections.

* * * * *